United States Patent [19]

Li

[11] Patent Number: 4,521,484

[45] Date of Patent: Jun. 4, 1985

[54] SELF-CRIMPING POLYAMIDE FILAMENTS

[75] Inventor: George T. C. Li, Ridgeway, Va.

[73] Assignee: E. I. Du Pont de Nemours and Company, Wilmington, Del.

[21] Appl. No.: 618,105

[22] Filed: Jun. 7, 1984

[51] Int. Cl.[3] ..... D02G 3/00

[52] U.S. Cl. ..... 428/374; 428/370; 428/371; 428/397

[58] Field of Search ..... 428/370, 371, 373, 374, 428/369, 397; 264/171; 528/339

[56] References Cited

U.S. PATENT DOCUMENTS

| | | | |
|---|---|---|---|
| 3,316,589 | 5/1967 | Hollandsworth, Jr. . | |
| 3,383,369 | 5/1968 | Ridgway | 528/339 |
| 3,399,108 | 8/1968 | Olson . | |
| 3,418,199 | 12/1968 | Anton et al. . | |
| 3,423,923 | 1/1969 | Hume . | |
| 3,432,476 | 3/1969 | Kuwabara et al. | 528/339 |
| 3,526,571 | 9/1970 | Ogata | 428/373 |
| 3,621,089 | 11/1971 | Blackley et al. . | |
| 3,675,408 | 7/1972 | Pacini et al. . | |
| 3,901,989 | 8/1975 | Hokonoki et al. . | |
| 3,926,924 | 12/1975 | Edgar | 528/339 X |
| 4,069,363 | 1/1978 | Segraves et al. . | |
| 4,218,509 | 8/1980 | Edgar et al. . | |
| 4,238,603 | 12/1980 | Chapman et al. . | |

FOREIGN PATENT DOCUMENTS

| | | | |
|---|---|---|---|
| 1346103 | 2/1974 | United Kingdom | 264/171 |

*Primary Examiner*—Lorraine T. Kendell

[57] ABSTRACT

A crimpable nylon bicomponent filament have a poly(-hexamethylene adipamide) sheath and an eccentrically located core of a terpolymer of hexamethylene adipamide, hexamethylene isophthalamide and hexamethylene terephthalamide units in defined proportions.

4 Claims, No Drawings

SELF-CRIMPING POLYAMIDE FILAMENTS

DESCRIPTION

1. Technical Field

This invention relates to bicomponent polyamide filaments capable of forming a helical crimp upon relaxation and more particularly to such filaments having a copolyamide as the higher shrinking component.

2. Background Art

U.S. Pat. No. 3,399,108 discloses certain self-crimpable polyamide filaments of two components, one being a homopolyamide and the other a more shrinkable, copolyamide. Poly(hexamethylene adipamide) is disclosed as being a suitable homopolyamide. Included among disclosed copolyamides are certain random copolyamides of hexamethylene adipamide units together with hexamethylene isophthalamide units and especially ones containing 20 to 40% by weight of hexamethylene isophthalamide units. Although such copolyamides can provide sufficiently high shrinkage to provide adequate crimpability for some end-uses, their low melting points relative to poly(hexamethylene adipamide) can present processing difficulties during melt-spinning and the resulting filaments for some applications can be deficient in crimp recovery and dimensional stability in the presence of moisture.

An object of this invention is a self-crimping polyamide filament made from readily available and economically priced monomeric materials which provide filaments having good textile processability and improved spinnability along with improved fiber properties relative to known bicomponent polyamide filaments based upon hexamethylene adipamide and hexamethylene isophthalamide units. Other objectives will be apparent from the following disclosure.

SUMMARY OF THE INVENTION

The present invention is directed to a sheath-core bicomponent synthetic filament capable of forming a helical crimp upon relaxation consisting essentially of an oriented poly(hexamethylene adipamide) sheath comprising from 35% to 50% by weight of the filament and an eccentrically located ternary copolyamide core which consists essentially of at least about 60% by weight of hexamethylene adipamide units, from about 15% to 30% by weight of hexamethylene isophthalamide units and from about 5% to 10% by weight of hexamethylene terephthalamide units, the ratio of the weight percentages of the hexamethylene isophthalamide units to the hexamethylene terephthalamide units being between 1.5 and 6.0, preferably 1.5–3.0.

DETAILED DESCRIPTION OF THE INVENTION

The filament of the present invention is a nylon bicomponent filament having an oriented sheath of poly(hexamethylene adipamide) surrounding an eccentrically located core comprising a copolyamide of hexamethylene adipamide, hexamethylene isophthalamide and hexamethylene terephthalamide units in defined proportions. Both the sheath and the core extend continuously along the length of the filament. When heated under little or no tension, helical crimp is induced due to differential shinkage of the two components, the copolyamide being the higher shrinking component. The filament yarn has many attributes making it particularly useful in knit fabric structures such as hose where it serves as a single cover yarn for spandex filaments. Among the attributes are low cost ingredients, ease of manufacture, high crimp development and high crimp recovery.

The filaments can be spun and processed by conventional techniques and with known apparatus.

To obtain maximum crimpability in standard round cross-section filaments, i.e., highest crimp level upon relaxation of the drawn bicomponent filament, the core should be displaced from the filament axis such that only a very thin sheath, for instance, one having a thickness equivalent to about 1% of the total filament diameter, separates it from the outside of the filament. U.S. Pat. No. 3,316,589 describes spinnerets and techniques for spinning such filaments. A filament cross-section as shown in FIG. 1 of U.S. Pat. No. 4,069,363 is preferred. The sheath should comprise from 35% to 50%, preferably from 40% to 45% by weight of the filament.

Both components of the filament of this invention must be extruded from polymer of fiber-forming molecular weight in order to avoid undue processing difficulties and to provide filaments which have good strength and crimpability. The respective polymers can be made in accordance with techniques well known in the art. It is preferred for spinnability and maximizing crimp development that the sheath polymer have a relative viscosity (RV) within the range 45 to 55 and that the core copolyamide have an RV from about 13 to 14 units less.

The core copolyamide must have a balance of properties needed to provide high crimpability and crimp recovery in the bicomponent filament. It must also have processing compatibility with the sheath polymer so as to permit satisfactory spinning and drawing under commercially acceptable conditions. This combination of crimpability, crimp recovery and processability is realized when the copolyamide consists essentially of at least about 60% by weight of hexamethylene adipamide (6.6) units, from about 15% to 30% by weight of hexamethylene isophthalamide (6I) units and at least about 5% to 10% by weight of hexamethylene terephthalamide (6T) units with the ratio of 6I to 6T units being from 1.5 to 6.0, preferably from about 1.5 to about 3.0.

The presence of 6I units in the copolyamide provides high crimpability in the bicomponent filament but crimp recovery, which is especially important in hosiery end-uses is low. At least about 15% by weight of 6I units is required to give adequate crimp in the filament. Crimp recovery is adversely effected if more than 30% by weight of 6I units is present. Addition of the 6T units to the copolyamide improves crimp recovery characteristics of the filaments and improves melt-spinning performance. At least about 5% by weight of 6T units is needed to give a noticeable increase in crimp recovery. However, the upper limit of 10% by weight of 6T units should not be exceeded if undue reduction in crimpability and an increase in draw-breaks during processing of the filaments is to be avoided.

TEST PROCEDURES

Tensile Properties

The tensile properties of the yarn were measured on an Instron Tensile tester. Before testing, packaged yarn was conditioned at least 2 hours in a 65±2% RH, 70°±2° F. atmosphere. Sample length of 10 inches (25.4 cm) was clamped between the jaws of the tester. A stress-strain curve was obtained while the yarn sample was being extended at a rate of 12 in/min (30.5 cm/min). The yarn Tenacity (T) is determined as the load in grams at the point of failure divided by denier of the yarn. Elongation (% E) is the percent increase in length of the sample at the point of failure. Modulus is measured as the initial slope of the stress-strain curve.

Crimp Properties

A 1050 denier skein of yarn was wound on a denier reel with the required revolutions to give a skein approximately 44 in (112 cm) long. The skein was hung on a rotary magazine (capable of handling 30 skeins) and conditioned for at least 30 minutes under 2.5 gms load at 65±2% RH and 70°±2° F. atmosphere. A 700 gm weight was then hung from the suspended skein, and the initial length of the skein (L1) was measured. The 700 gm weight was then replaced with a 2.5 gm weight to provide a tensile loading of 1.2 mg/denier. The magazine with the suspended skein was then submerged under water in a bath, controlled at a temperature of 95°±2° C. for 1.5 minutes. The skein/magazine assembly was then removed from the water bath and allowed to dry for 3–4 hours. The length of the crimped skein (L2) with the 2.5 gm load was measured. Finally, the 2.5 gm weight was replaced by the 700 gm weight and the length (L3) was measured.

The crimp potential (CP) in percent is computed as:

$$CP=(L3-L2)/L2\times 100$$

The crimp shrinkage (CS) in percent is calculated as:

$$CS=(L1-L3)/L1\times 100$$

Relative Viscosity

The term "relative viscosity" as used herein is the ratio of flow time in a viscometer of a polymer solution containing 8.2±0.2% by weight of polymer to the flow time of the solvent by itself wherein the solvent is 90% by weight formic acid. Measurements as reported herein are made with 5.5 g of polymer in 50 ml of formic acid at 25° C.

EXAMPLE 1

This example demonstrates crimpability and crimp recovery of eccentric sheath-core filaments of the invention and of a control.

A terpolymer batch is prepared by mixing desired amounts of hexamethylene diamine (HMD), isophthalic acid, and terephthalic acid in water in a reactor heated to a temperature of 50°–70° C. Additional amounts of HMD or acids are added as needed to achieve a pH level of 7.6±0.3. The aqueous solution of the resulting hexamethylene isophthalamide (6I) and hexamethylene terephthalamide (6T) salts is then mixed with a hexamethylene adipamide (6.6) salt to provide the required terpolymer ratio. Desired amounts of antifoam, antioxidant and formic acid stabilizer are then added. The salt solution is first transferred into an evaporator where it is concentrated. The concentrated solution is then charged into an autoclave where it is heated to 160° C. and brought to a pressure of 250 psig (17.6 kg/cm$^2$ gauge). While maintaining constant pressure, the temperature is gradually raised to about 247° C. Finally, pressure is gradually reduced to ambient atmospheric pressure while temperature continues to rise to about 264°–274° C. The resultant polymer is held in an autoclave for 20 minutes before being extruded under pressure of inert gas into strands which are quenched with water and then cut into flake.

A 66 homopolymer and a 66/6I/6T terpolymer are separately melted using vacuum exhausted screw extruders. The Relative Viscosity (RV) of the molten polymers sampled just prior to entering the spinneret assembly are 52.6 for 66 polymer and 39.7 for terpolymer. Separate metering pumps feed the two melts at 287° C. to the spinneret assembly at a rate adjusted to provide the desired weight ratio of sheath (66) and core (terpolymer). Upon exiting from the spinneret, the filaments are air quenched and steam-conditioned. Finish is applied before being wound up at 750 yards per minute. Quenching is accomplished in a 60 inch (152 cm) chimney with cross-flow air at 52° F. (10.5° C.). Steam conditioning is achieved by passing the yarn through an interfloor tube of 80 inches (203 cm) long containing saturated steam at atmospheric pressure.

The spun yarn is further drawn to a desired draw ratio (3.24X) over an unheated draw pin located between the feed and draw rolls on a commercial draw-twister. The drawn yarn is immediately packaged using a ring- and traveler windup.

In Table 1 below, a 42/58 sheath-core ratio is used. Item 1 has the composition 66/6I/6T. The weight % of the units are 70/22.5/7.5 for Item 1. The yarn is knit into hosiery as leg yarn and its Crimp Index (CI) measured before and after wearing. CI and Crimp Recovery are determined as follows:

A skein of yarn (about 400 denier) having a circumference of about one meter is made by unravelling yarn from a hose onto a wheel. The skein is removed from the wheel and extended slightly to remove snags and then allowed to relax by hanging for 30 seconds. The skein is loaded with a 1.8 gm weight for about 5 minutes and its length recorded ($L_R$). The skein is then loaded with a 500 gm weight and the extended length ($L_E$) is recorded. Crimp index (CI) in percent is calculated by the equation $$CI = \frac{L_E - L_R}{L_E} \times 100$$

For Table I, yarn was unravelled from unworn hose and from hose worn 1, 3 and 5 days. Measurements are made immediately after wearing. Crimp recovery in percent is calculated by the equation $$\text{Crimp Recovery} = \frac{CI\ (\text{after wearing for 1, 3 or 5 days})}{CI\ (\text{unworn})}$$

TABLE 1

| Item | 1 |
|---|---|
| CI, | |
| Before wearing | 59.9 |
| 1 Day worn | 38.7 |
| 3 Days worn | 38.1 |
| 5 Days worn | 37.5 |
| Crimp Recovery, | |
| 1 Day worn | 65 |
| 3 Days worn | 64 |
| 5 Days worn | 63 |
| Average | 64 |

As a control, an eccentrically disposed sheath-core bicomponent yarn having a 41/58 sheath-core ratio, the sheath being nylon 6.6 and the core being 6.6/6I (70/30)

weight %, is examined for CI and crimp recovery. A sample of yarn removed from a finished hose is subjected to a 1 gm/denier load for periods of one minute and 10 minutes. Length measurements are made before, during and after the loaded periods. For unloaded (relaxed) length measurements the yarn is straightened, but not tensioned so as to remove its crimp. The equations and results follow:

$$CI \text{ (Before loading)} = \frac{L_x - L_o}{L_x} \times 100 = 67.5\%$$

$$CI \text{ (After loading 1 min)} = \frac{L_1 - L_2}{L_1} \times 100 = 29.8\%$$

$$CI \text{ (After loading 10 min)} = \frac{L_3 - L_4}{L_3} \times 100 = 18.9\%$$

where:
$L_o$=initial relaxed length
$L_x$=mean loaded length
$L_1$=loaded length, 1 minute duration
$L_2$=relaxed length after removing 1 minute load
$L_3$=loaded length, 10 minute duration
$L_4$=relaxed length after removing 10 minute load Crimp Recovery, %

$$\text{After loading 1 min.} = \frac{CI \text{ after loading one min}}{CI \text{ before loading}} = 44\%$$

$$\text{After loading 10 min.} = \frac{CI \text{ after loading 10 min}}{CI \text{ before loading}} = 28\%$$

EXAMPLE 2

This example illustrates the criticality of the specified sheath/core ratio and process performance of the new bicomponent filament.

Several random ternary copolyamides of hexamethylene adipamide, hexamethylene isophthalamide and hexamethylene terephthalamide units are tested as the core component in eccentric sheath-core filaments with poly(hexamethylene adipamide) as the sheath. Several sheath-core ratios also are tested for the effect on crimpability. The highly eccentric core is shaped substantially in the form of a semi-circle or "D" shape in which the core is positioned substantially along one half of the filament with only a thin sheath surrounding it on that side, as shown in U.S. Pat. No 4,069,363. Crimpability of the filaments is measured in terms of Crimp Potential (CP) and Crimp Shrinkage (CS) after relaxation in a hot bath. The filaments are spun and drawn using a draw-twister in a conventional manner using various draw ratios. The yarns contain 8 filaments. Six copolyamide compositions are used. Copolyamide A contains 70/15/15 percentages by weight of hexamethylene adipamide/hexamethylene isophthalamide/hexamethylene terephthalamide units respectively. Copolyamide B contains 70/20/10 percent by weight of the respective units. Copolyamide C contains 60/25/15 percent by weight of the respective units. Copolyamide D contains 70/22.5/7.5 percent by weight of the respective units. Copolyamide E contains 65/25/10 percent by weight of the respective units. Copolyamide F contains 60/28.5/11.5 percent by weight of the respective units. Representative results selected from a large number of items are shown in Table 2. Best crimpability is obtained with filaments containing less than 50% by weight of the sheath polymer.

Items 6A and 6B are spun at 600 ypm. Items 9, 12 and 18 are spun at 800 ypm. Items 2, 4 and 6 are spun at 750 ypm. All the items are drawn at a draw ratio within the range 3.46 to 3.609 X. Tenacity/Elongation/Modulus (T/E/M) are reported in grams per denier/elongation at break/initial modulus in grams per denier respectively. Items 2 and 4 are within the scope of this invention.

TABLE 2

| Item | Core Polymer | S/C Ratio | Drawn Denier | T/E/M | CP | CS |
|---|---|---|---|---|---|---|
| 6A | A | 60/40 | 21.0 | 5.0/34/38 | 5 | 13 |
| 6B | A | 55/45 | 15.8 | —/31/— | 7 | 13 |
| 9 | B | 55/45 | 18.0 | 5.5/28/44 | 8 | 14 |
| 12 | B | 60/40 | 17.2 | 5.4/25/49 | 7 | 12 |
| 18 | C | 60/40 | 15.9 | /*/ | 15 | 13 |
| 2 | D | 42/58 | 16.0 | 4.7/34.5/42.8 | 28.6 | 15.4 |
| 4 | E | 42/58 | 16.0 | 4.4/32.4/40.1 | 45.6 | 17.2 |
| 6 | F | 42/58 | 16.0 | 4.3/32.7/44.2 | 51.4 | 17.5 |

*Bad breaks

The improved crimp properties of the fiber of this invention having % sheath less than 50 (items 2, 4 and 6) is readily apparent. Performance in draw-twisting of yarns represented by items 2, 4 and 6 is dependent on the relative amount of terephthalamide units in the terpolymer. During a plant run under actual industrial conditions Item 2 had no draw-twister breaks; Item 4 had a marginally acceptable amount of draw-twister breaks; and Item 6 had an unacceptably high amount of draw-twister breaks.

I claim:

1. A sheath-core bicomponent synthetic filament capable of forming a helical crimp upon relaxation consisting essentially of an oriented poly(hexamethylene adipamide) sheath comprising from 35% to 50% by weight of the filament and an eccentrically located ternary copolyamide core which consists essentially of at least about 60% by weight of hexamethylene adipamide units, from about 15% to 30% by weight of hexamethylene isophthalamide units and from about 5% to 10% by weight of hexamethylene terephthalamide units, the ratio of the weight percentages of the hexamethylene isophthalamide units to the hexamethylene terephthalamide units being from 1.5 to 6.0.

2. A filament of claim 1 wherein the sheath comprises from about 40% to about 45% by weight of the filament.

3. A filament of claim 1 wherein the ratio of the weight percentage of hexamethylene isophthalamide units to that of the hexamethylene terephthalamide units is within the range of from about 1.5 to about 3.0.

4. A filament of claim 1 wherein the relative viscosity of the copolyamide is from about 13 to 14 units less than that of the poly(hexamethylene adipamide).

* * * * *